US005484016A

United States Patent [19]

Surjaatmadja et al.

[11] Patent Number: 5,484,016

[45] Date of Patent: Jan. 16, 1996

[54] SLOW ROTATING MOLE APPARATUS

[75] Inventors: Jim B. Surjaatmadja; Timothy W. Helton, both of Duncan, Okla.

[73] Assignee: Halliburton Company, Duncan, Okla.

[21] Appl. No.: 250,406

[22] Filed: May 27, 1994

[51] Int. Cl.[6] ..... E21B 43/00

[52] U.S. Cl. ..... 166/104; 166/223

[58] Field of Search ..... 166/104, 117.7, 166/174, 222, 223, 307, 311, 312; 175/67

[56] References Cited

U.S. PATENT DOCUMENTS

| | | | |
|---|---|---|---|
| 3,145,776 | 8/1964 | Pittman | 166/55 |
| 3,892,274 | 7/1975 | Dill | 166/222 |
| 3,958,641 | 5/1976 | Dill et al. | 166/312 |
| 4,346,761 | 8/1982 | Skinner et al. | 166/206 |
| 4,625,799 | 12/1986 | McCormick et al. | 166/223 |
| 4,705,107 | 11/1987 | Council et al. | 166/170 |
| 4,744,420 | 5/1988 | Patterson et al. | 166/312 |
| 4,781,250 | 11/1988 | McCormick et al. | 166/240 |
| 4,818,197 | 4/1989 | Mueller | 418/48 |
| 5,029,644 | 7/1991 | Szarka et al. | 166/223 |
| 5,097,902 | 3/1992 | Clark | 166/187 |
| 5,361,856 | 11/1994 | Surjaatmadja et al. | 166/307 X |

OTHER PUBLICATIONS

Otis Engineering Corporation Brochure entitled "Break Down Buildups and Restore Production with Hydra–Blast® Services" (1988).

Paper entitled "Principles of Hydraulic Jet Cleaning" dated Jul. 2, 1987.

Catalog of Stoneage Waterjet Engineering (Undated but admitted to be prior art).

Halliburton Services Catalog Excerpt Section 6: Wellbore Cleanout (Jan., 1993).

Otis Engineering Corporation Products and Services Brochure (1989), p. 283.

*Primary Examiner*—Roger J. Schoeppel

*Attorney, Agent, or Firm*—Stephen R. Christian; Neal R. Kennedy

[57] ABSTRACT

A slow rotating mole apparatus for use in hydrablasting wellbores and pipelines. The apparatus generally consists of a motor section with a rotor rotatable in response to fluid flow through the motor section, a speed reducer section connected to the motor section such that an output speed of the speed reducer section is less than an output speed of the rotor, and a jetting section attached to the speed reducer section and rotated thereby at the speed reducer output speed. The speed reducer section and jetting section define a flow passage therethrough in communication with jetting ports in the jetting section so that the fluid pumped through the apparatus is jetted therefrom. The speed reducer section may include one or more gear reductions to achieve the desired rotational speed of the jetting section.

20 Claims, 3 Drawing Sheets

SLOW ROTATING MOLE APPARATUS

BACKGROUND OF THE INVENTION

1. Field of the Invention

This invention relates to rotating moles used in well hydrablasting work, and more particularly, to a slow rotating mole powered by a mud pump and driven through a wobble gear speed reducer.

2. Description of the Prior Art

The buildup of materials on the inside of pipelines and well casing or tubing is a common problem. It is known that many wells in some areas have buildup problems severe enough to eventually plug the tubing, and this problem may occur in both production and injection wells. Pipelines have similar problems.

Common compounds causing such buildup problems are barium sulfate, silicates, calcium carbonate, calcium sulfate, carbonate, sulfate, silica, water scale with hydrocarbons, coke tar, coke and complexes, wax and complexes, paraffins, sludges, muds and gels.

Many different methods have been used to remove material buildup. For example, one method of dealing with paraffin buildup is to melt the paraffin with hot oil. Hot oil units heat crude oil, and the heated oil is circulated into the well. Hot water has also been used to melt or remove paraffin and also to remove salt. While in many cases this technique is successful, it does have the disadvantage of requiring considerable energy to heat the oil or water, and it is not useful in removing other materials which will not melt from the heat or which are not water soluble.

Chemicals may also be used to dissolve paraffin deposits. This may eliminate the problem of heating, but the chemicals may require special handling because they are usually highly flammable and toxic.

Other methods to remove buildup include Dyna-Drills run on coiled tubing, milling with jointed tubing, acid washing, and broaching with a wireline.

To avoid the problem of removal of buildup by hot oil or water or by chemicals, jet cleaning was developed to utilize high pressure liquids to remove the materials by erosion. Coiled tubing service companies have performed jet cleaning jobs for many years. Generally, these jobs have been limited to removing mud cake, paraffin or packed sand. The jet cleaning tools of this type are usually made of heavy wall mechanical tubing with a plurality of holes of various diameters drilled in a symmetrical pattern around the tool. Water is used as the cleaning media. Job results were usually unpredictable. All of these techniques have achieved limited success, and it has been necessary on many occasions to change out the production tubing string. Accordingly, there is a need to efficiently and thoroughly clean material buildup in well casing or tubing.

The Otis "HYDRA-BLAST"® system was developed to address these problems by providing an economical means of cleaning buildup deposits from downhole tubing. This system utilizes high pressure fluid jet technology in conjunction with the economy and efficiency of coiled tubing. The "HYDRA-BLAST"® system includes an indexing jet cleaning tool, an in-line high pressure filter, a surface filter unit, a circulation pump with tanks and a coiled tubing unit. It also utilizes a computer program to design the actual cleaning jobs for any particular situation. The optimum jet size and number, retrieval speed and number of passes is calculated to accomplish a successful job, and this is particularly important in trying to remove harder materials such as the harder barium compounds. In general, this system may be described as a water-blasting system which directs high pressure streams of water against the buildup to remove the material by the eroding or cutting action of moving fluid.

In a typical application of the "HYDRA-BLAST"® system, the operator uses a cleaning tool which usually utilizes a downward stream to cut into the material as the tool is lowered into the tubing. This portion of the tool is not particularly well adapted for removing large amounts of buildup along the walls after the tool is free to pass therein. So, the original down-blast tool is removed from the well, and an additional trip is made with a side-blast jetting head designed specifically for the purpose of providing jets directed against the buildup on the walls of the tubing. Reciprocation of the tool is usually necessary for thorough cleaning. This two-step process works well for short or moderate length buildup areas, but it is not particularly well adapted for extremely long buildup areas because it is difficult to rotate and reciprocate the tool to cover such an area. Also, without the ability to rotate, a large number of nozzles will be needed to provide good coverage which will increase flow and pressure drop due to fluid friction. This reduces the efficiency of the jets. Therefore, a need exists for a tool with low pressure drop which can be used to blast a long area of buildup and which needs only one trip into the wellbore and does not retrace its path.

The rotating mole system of the present invention solves this problem by providing a tool which rotates slowly as it is lowered into the tubing, so that it provides a complete 360° path of jetted fluid as it is moved longitudinally. Very few jets are required for this tool. This configuration also makes the tool well adapted for use in pipeline cleanout where a long path is frequently present.

SUMMARY OF THE INVENTION

The present invention comprises a slow rotating mole apparatus for use in hydrablasting work in wellbores and pipelines.

The slow rotating mole apparatus may be described as a jetting apparatus comprising a motor section providing rotation in response to a flow of fluid therethrough, a speed reducer section defining a flow passage therethrough and connected to the motor section such that an output speed of the speed reducer section is less than an output speed of the motor, and a jetting section attached to the speed reducer section and rotated thereby at the output speed of the speed reducer section. The jetting section defines at least one jetting port in communication with the flow passage through which said fluid is jetted. In the preferred embodiment, an orifice is disposed in the jetting port.

The motor section comprises a progressive cavity motor having a rotor rotatably disposed in an elastomeric stator. A coupling may be used to connect the rotor to the speed reducer section.

The speed reducer section preferably comprises a body defining a geared surface therein, a follower gear in geared engagement with said geared surface and rotatably disposed in said body, and an input shaft connected to the rotor in the motor by the coupling. The input shaft has an eccentric portion engaging the follower gear such that, as the input shaft is rotated, the follower gear is rotated eccentrically in the geared surface. The apparatus may have one or more such gear reductions. For example, a second gear reduction in the speed reducer section may comprise a body or adapter defining a second geared surface therein and a second follower gear in geared engagement with the second geared surface and rotatably disposed in the body or adapter. The first follower gear includes a lower portion acting as another input shaft and having an eccentric portion engaging the second follower gear such that, as the first follower gear is rotated, the second follower gear is rotated eccentrically in the second geared surface. Any number of such gear reduction assemblies may be used.

The follower gear is preferably a wobble gear which is tilted slightly with respect to a central axis of the body. The amount of tilt is quite small and preferably no greater than about twice the height of a gear tooth in the geared surface. Bushings rotatably support the follower gears while still allowing this slight wobble movement.

Numerous objects and advantages of the invention will become apparent as the following detailed description of the preferred embodiments is read in conjunction with the drawings which illustrate such embodiments.

DESCRIPTION OF THE PREFERRED EMBODIMENT

Figure 1A:
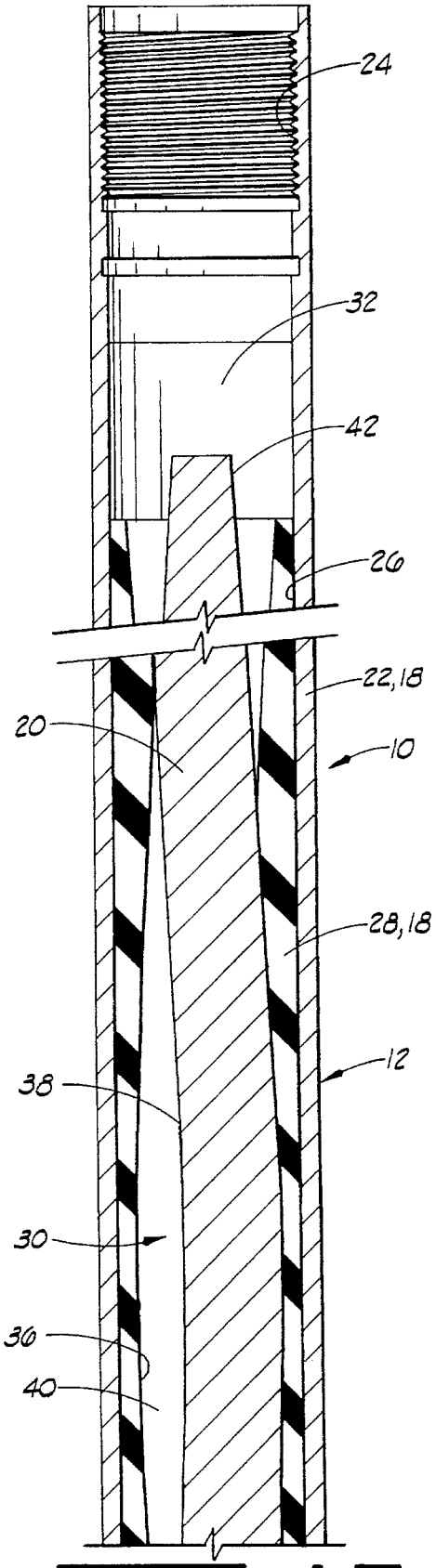
FIGS. 1A–1D show a longitudinal cross section of a preferred embodiment of the slot rotating mole apparatus of the present invention.

Referring now to the drawings, and more particularly to FIGS. 1A–1D, a preferred embodiment of the slow rotating mole apparatus of the present invention is shown and generally designated by the numeral 10. Jetting apparatus 10 generally comprises a motor section 12, a speed reducer section 14, and a jetting section 16. Motor section 12 is used to provide torque for operating jetting section 16. Speed reducer section 14 reduces the rotational speed between motor section 12 and jetting section 16.

Motor section 12 is of a kind known in the art commonly referred to as mud pumps or motors and generally comprises a progressive cavity motor having a stator assembly 18 with a rotor 20 rotatably disposed in the stator assembly.

Stator assembly 18 includes a stator case 22. Stator case 22 has a threaded inner surface 24 at its upper end which is adapted for connection to a coiled tubing unit or other tool string. A longitudinal bore 26 is defined through stator case 22, and a stator 28 is disposed in bore 26 and preferably in sealing contact therewith. Stator 28 is made of an elastomeric material.

Rotor 20 extends through stator 28 and is substantially coaxial with the stator and stator case 22.

Stator 28 and rotor 20 define an axially extending motor chamber 30, which may also be referred to as a driving chamber 30, therein. Motor chamber 30 is in communication at its upper end with an inlet chamber 32 in stator case 22 and a generally annular outlet chamber 34 at the lower end of the stator case. The inner surface of stator 28 defining motor chamber 30 preferably is corrugated such that a helical screw-like thread 36 is defined therealong.

The outer surface of rotor 20 defines a rounded, substantially helical screw-type threaded surface 38 thereon. The interaction of threaded rotor surface 38 with threaded stator surface 36 in motor chamber 30 forms a plurality of cavities 40 spaced along the length of the pumping chamber.

Rotor 20 has a tapered upper end 42 adjacent to inlet chamber 32 and a tapered lower end 44 adjacent to outlet chamber 34.

Figure 1B:
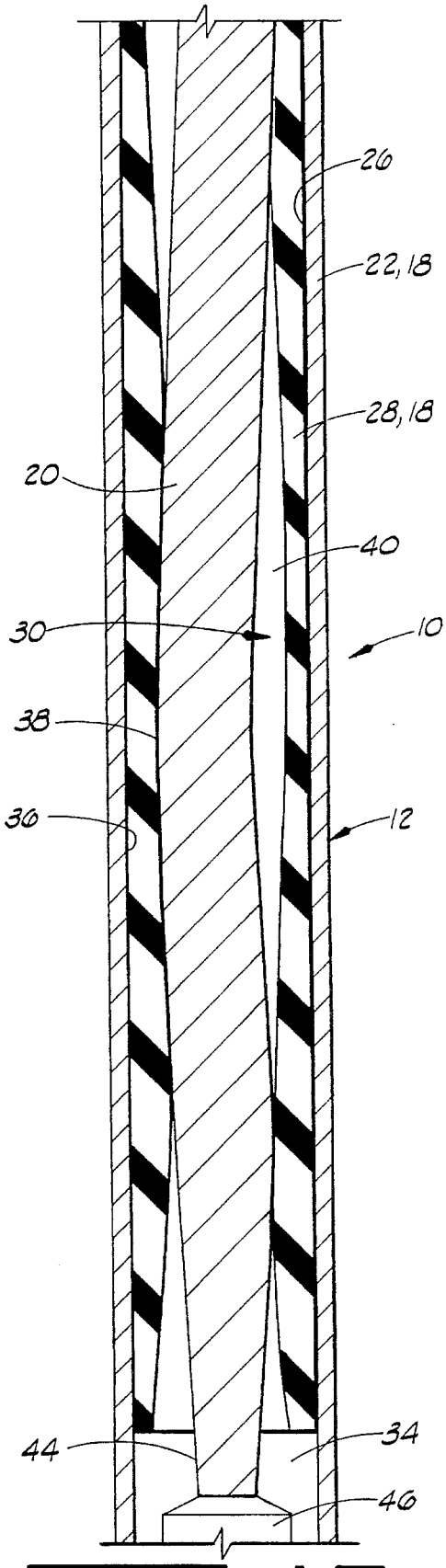

Lower end 44 of rotor 20 is connected to a rotor adapter 46 as seen in FIG. 1B.

Rotor adapter 46 is attached to an upper coupling adapter 48 at threaded connection 50. Upper coupling adapter 48 is connected to a lower coupling adapter 52 by a swivel assembly 54. Upper coupling adapter 48, lower coupling adapter 52 and swivel assembly 54 form a U-joint coupling assembly 56 of a kind known in the art.

Lower coupling adapter 52 is attached to an input shaft 58 at threaded connection 60. Input shaft 58 has a bore 62 therethrough which is placed in communication with outlet chamber 34 by a plurality of ports 64.

The lower end of stator case 22 of motor section 12 is attached to a speed reducer body 66 of speed reducer section 14 at threaded connection 68. A sealing means, such as O-ring 70 provides sealing engagement between speed reducer body 66 and stator case 22.

Input shaft 58 has a first outside diameter 72 and a smaller second outside diameter 74 which is generally concentric with first outside diameter 72. Second outside diameter 74 is rotatably disposed in a bushing 76 positioned within speed reducer body 66 and stator case 22. The lower end of input shaft 52 includes a third outside diameter 78 which is eccentric with respect to first and second outside diameters 72 and 74. That is, the longitudinal axis of third outside diameter 78 is substantially parallel to and spaced from the longitudinal axis of the rest of input shaft 58.

Third outside diameter 78 of input shaft 58 extends into bore 80 of a first follower gear 82. The lower end of input shaft 80 is supported on a bearing 84 disposed in first follower gear 82. A central opening 83 is defined through first follower gear 82.

Figure 1C:
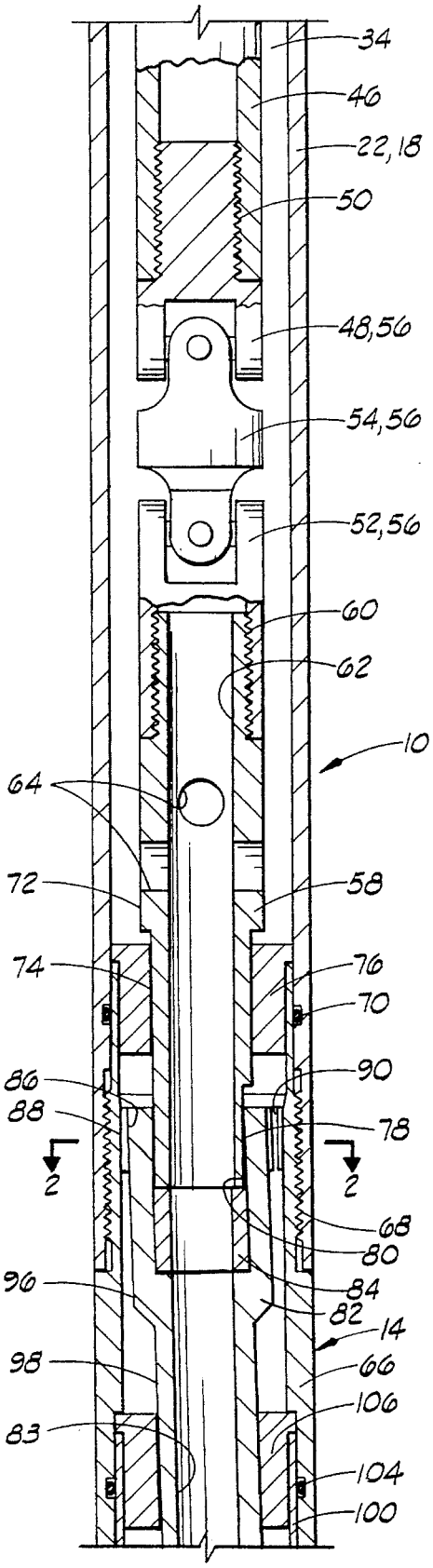
Figure 1D:
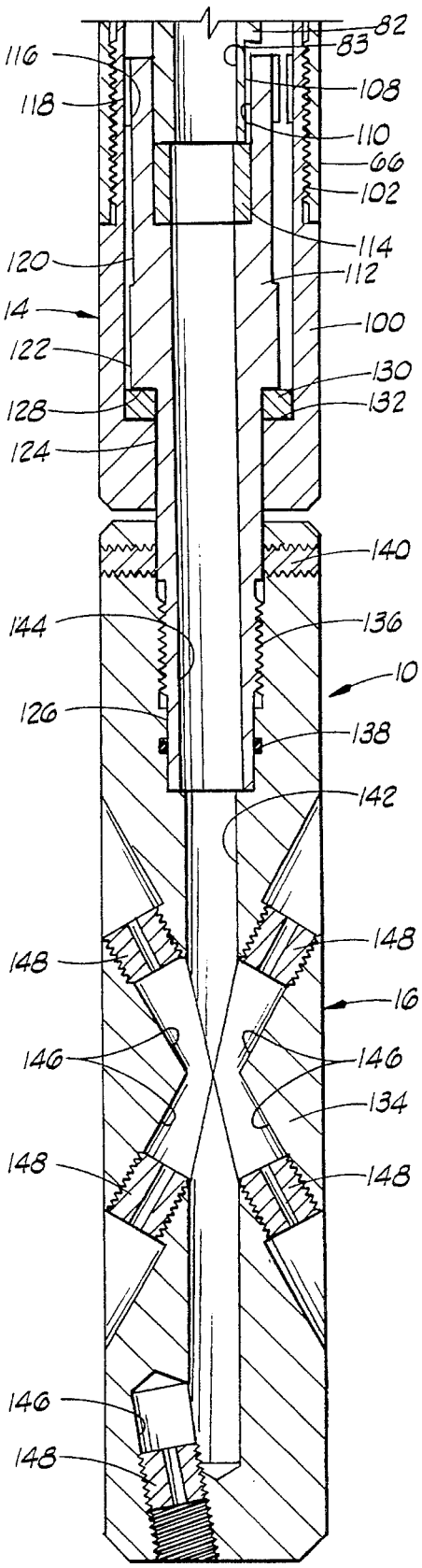
Figure 3:
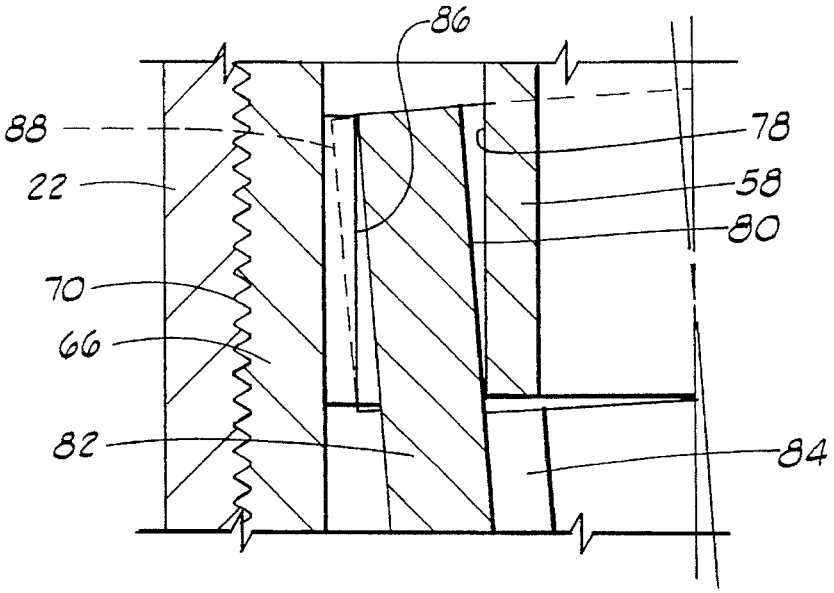
FIG. 3 shows an enlarged area of a gear reduction section of the slow rotating mole system.
Figure 2:
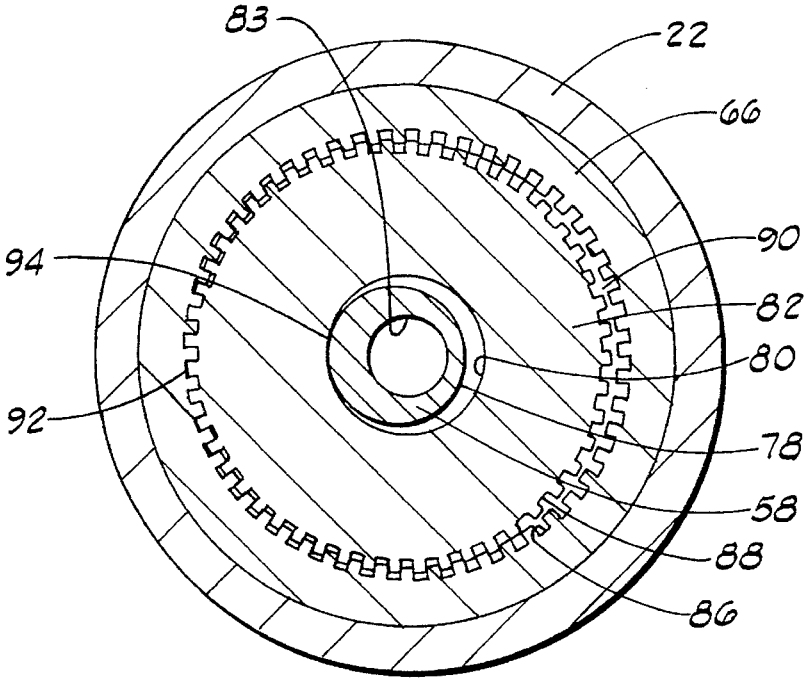
FIG. 2 is a cross section taken along lines 2—2 in FIG. 1C.

Referring now also to FIG. 2 and 3, speed reducer body 66 has an internally geared surface 86. First follower gear 82 has an outer geared surface 88. Geared surface 88 of first follower gear 82 is partially engaged with geared surface 86 in speed reducer body 66. As seen in FIG. 1C, 2 and 3, this geared engagement is shown to the left. That is, a gap 90 extends between geared surfaces 86 and 88 toward the right of first follower gear 82. A center point of engagement is indicated at 92.

Because of the eccentricity of third outside diameter 78 of input shaft 50, third outside diameter 78 bears against bore 80 in first follower gear 82 at a point of engagement 94. As best seen in FIG. 3, but also visible in FIG. 1C, this causes first follower gear 82 to be tilted slightly out of the longitudinal axis of apparatus 10 so that outer geared surface 88 thereof is engaged with inner geared surface 86. It should be understood that the amount of tilt is exaggerated in the drawings, and the actual angle of deflection is very small. However, there is some tilt, and thus, first follower gear 82 may be referred to as a wobble gear.

By rotation of input shaft 58, the point of engagement 94 of third outside diameter 78 of input shaft 50 with bore 80 in first follower gear 82 will be correspondingly rotated around bore 80. Those skilled in the art will see that the corresponding point of engagement 92 of first follower gear 82 with speed reducer body 66 will be correspondingly rotated around geared surface 86. It will also be seen from a study of FIG. 2, that as input shaft 58 is rotated clockwise with respect to FIG. 2, that the central axis of first follower gear 82 will also be moved clockwise about the axis of input shaft 58, as will point of engagement 92. This results in an opposite counterclockwise rotation of first follower gear 82 about its axis.

The assembly of these components will therefore act as a speed reducer. That is, the rotation of first follower gear 82 about its axis will have a speed considerably less than the speed of rotation of input shaft 58. In one embodiment for example, a rotational speed of 2000 rpm for input shaft 58 may result in a rotational speed of approximately 60 to 100 rpm for first follower gear 82. The invention is not intended to be limited to this particular speed reduction, and the speed reduction may be varied as desired.

First follower gear 82 has a first outside diameter 96 below outer geared surface 88 and a second outside diameter 98 which is concentric with the first outside diameter.

The lower end of speed reducer body 66 is attached to a speed reducer adapter 100 at threaded connection 102, as seen in FIG. 1B. Speed reducer adapter 100 may be considered an extension of speed reducer body 66 and may be identified as a second body 100. A sealing means, such as an O-ring 104, provides sealing engagement between speed reducer body 66 and speed reducer adapter 100.

Second outside diameter 98 of first follower gear 82 is rotatably supported in a bushing 106 disposed within speed reducer body 66 and speed reducer adapter 100. The dimensional tolerances between bushing 106 and second outside diameter 98 of first follower gear 82 are such that rotatable support is provided to the follower gear by the bushing, but the slight degree of tilt of first follower gear 82, previously described, is allowed.

The lower end of first follower gear 82 has a third outside diameter 108 which is eccentrically disposed with respect to first and second outside diameters 96 and 108. That is, the longitudinal axis of third outside diameter 108 is parallel to and spaced from the longitudinal axis of first and second outside diameters 96 and 98.

Third outside diameter 108 of first follower gear 82 extends into bore 110 of a second follower gear 112. The lower end of first follower gear 82 is supported on a bearing 114 disposed in second follower gear 112.

Speed reducer adapter 100 defines an inner geared surface 116 therein which is engaged by an outer geared surface 118 on second follower gear 112. This engagement is substantially the same as that previously described between first follower gear 82 and speed reducer body 66. That is, second follower gear 112 tilts slightly out of the longitudinal axis of apparatus 10 in a manner similar to that shown in FIG. 3, and may also be referred to as a wobble gear.

In a manner also similar to first follower gear 82, second follower gear 112 has a point of engagement which is rotated in the same direction as the rotation of first follower gear 82, and this results in rotation of second follower gear 112 in the opposite direction within speed reducer body 100.

Second follower gear 112 has a first outside diameter 120, a second outside diameter 122, a third outside diameter 124 and a fourth outside diameter 126. A downwardly facing shoulder 128 extends between second outside diameter 122 and third outside diameter 124. Shoulder 128 is supported on a bushing 130 which in turn bears against a shoulder 132 in speed reducer adapter 100. Bushing 130 also is sized to provide rotational support for third outside diameter 124 of second follower gear 112 while allowing some tilting thereof.

In the previously mentioned embodiment in which first follower gear 82 has a rotational speed in the range of about 60 to 100 rpm, the rotation of second follower gear 112 is reduced to approximately 2 to 6 rpm. If higher speeds are required, the design allows removal of the first speed reduction assembly including speed reducer body 66, first follower gear 82, bushing 76 and bearing 84 to obtain an output speed of around 60 to 100 rpm.

The lower end of second follower gear 112 of speed reducer section 14 extends downwardly out of speed reducer adapter 100 and is attached to a jetting body 134 of jetting section 16 at threaded connection 136. A sealing means, such as O-ring 138, provides sealing engagement between second follower gear 112 and jetting body 134. A retaining means, such as a plurality of set screws 140, may also be used to help retain jetting body 134 to second follower gear 112.

Jetting body 134 defines a central bore 142 therein which is in communication with a central opening 144 of second follower gear 112, and thus with central opening 83 of first follower gear 82. A plurality of jetting ports 146 are also defined in jetting body 134 and are in communication with central bore 142. A jetting orifice 148 is threadingly engaged with each jetting port 146. The number of jetting ports 146 and corresponding orifices 148 may be varied, as may be the direction of each of these ports and orifices. The invention is not intended to be limited to the configuration shown in FIG. 1D.

OPERATION OF THE INVENTION

To use the slow rotating mole apparatus 10 of the present invention, the apparatus is lowered into the wellbore on a tubing string until it is adjacent to the point where it is desired that jetting begin. Fluid is pumped under pressure through the tubing string into apparatus 10. This fluid is forced to flow through motor chamber 30, causing rotation of rotor 20 within the stator 28, and resulting in rotation of U-joint coupling assembly 56 and input shaft 58. U-joint coupling assembly 56 compensates for any misalignment between rotor 20 and input shaft 58 and also compensates for any eccentric or wobbling movement that may be associated with rotor 20 in the progressive cavity motor.

As previously described, this rotation of input shaft 58 results in a reduced speed of first follower gear 82 which results in even more of a reduction in the speed of second follower gear 112 and thus of jetting body 134. The fluid is pumped downwardly through a flow passage including bore 62 in input shaft 58, central opening 83 in first follower gear 82, central opening 144 in second follower gear 112 and central bore 142 in jetting body 134 so that it can be jetted out through orifices 148.

The slow rotation of jetting body 134 through this gear reduction system results in thorough pattern of jetting of liquid in all directions out of apparatus 10. The tubing string may be lowered slowly through the section to be cleaned. In this way, a thorough jetting of fluid is directed to all portions on the section to be cleaned, and only one trip of apparatus 10 is required. Also, fewer jetting ports are required than on non-rotating tools.

As previously described, the rotational speed of jetting body 134 may be easily increased by eliminating the first speed reduction components so that only one speed reduction is used. It will also be seen by those skilled in the art that if it is desired to further slow the rotation of jetting body 134, additional gear reduction sections could be used.

It will be seen, therefore, that the slow rotating mole apparatus of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A jetting apparatus for use in removing material buildup from an inner surface, comprising:

a motor section adapted for providing rotation in response to a flow of fluid therethrough;

a speed reducer section defining a flow passage therethrough and connected to said motor section such that an output speed of said speed reducer section is less than an output speed of said motor; and a jetting section attached to said speed reducer section and rotated thereby within said inner surface at said output speed of said speed reducer section, said jetting section defining a jetting port in communication with said flow passage through which said fluid is jetted.

2. The apparatus of claim 1 wherein said motor section comprises a progressive cavity motor.

3. The apparatus of claim 2 wherein said speed reducer section comprises:

a body defining a geared surface therein;

a follower gear in geared engagement with said geared surface and rotatably disposed in said body; and an input shaft connected to said motor, said input shaft having an eccentric portion engaging said follower gear such that, as said input shaft is rotated, said follower gear is rotated eccentrically in said geared surface.

4. The apparatus of claim 3 further comprising a coupling interconnecting said motor section and said input shaft.

5. The apparatus of claim 3 further comprising:

a second body defining a second geared surface therein; and a second follower gear in geared engagement with said geared surface and rotatably disposed in said second body;

wherein, a lower portion of the first mentioned follower gear has an eccentric portion engaging said second follower gear such that, as said first follower gear is rotated, said second follower gear is rotated eccentrically in said second geared surface.

6. The apparatus of claim 5 further comprising:

a first bearing disposed in said first mentioned follower gear for supporting a lower end of said input shaft; and a second bearing disposed in said second follower gear for supporting a lower end of said first mentioned follower gear.

7. The apparatus of claim 3 further comprising a bearing disposed in said follower gear for supporting a lower end of said input shaft.

8. The apparatus of claim 1 wherein said flow passage comprises:

a bore in said input shaft;

a central opening in said follower gear; and a central bore in said jetting section.

9. The apparatus of claim 1 wherein said jetting section comprises a jetting body attached to said follower gear.

10. A rotating mole apparatus comprising:

a hydraulic motor comprising a rotor which is rotatable in response to a flow of fluid through said motor;

a speed reducer comprising:

a body attached to said motor;

an inner geared surface disposed in said body;

a follower gear rotatably disposed in said body and defining a bore therein; and an input shaft connected to said rotor and having an eccentric portion engaging said bore in said follower gear such that, as said input shaft is rotated, said follower gear is rotated eccentrically in said inner geared surface; and a jetting body attached to said follower gear and rotatable therewith, said jetting body defining a jetting port through which said flow of fluid is jetted.

11. The apparatus of claim 10 wherein:

said follower gear is a first follower gear;

said inner geared surface is a first inner geared surface;

said first follower gear has an eccentric portion thereon; and further comprising:

a second inner geared surface disposed in said body; and a second follower gear rotatably disposed in said body, said eccentric portion of said first follower gear engaging said second follower gear such that, as said first follower gear is rotated, said second follower gear is rotated eccentrically in said second geared surface.

12. The apparatus of claim 10 further comprising a bushing for rotatably supporting said follower gear.

13. The apparatus of claim 10 wherein said motor is a progressive cavity motor.

14. The apparatus of claim 10 further comprising a bearing disposed in said bore in said follower gear for supporting a lower end of said input shaft.

15. The apparatus of claim 10 wherein said input shaft and said follower gear define a flow passage therethrough in communication with said jetting port.

16. The apparatus of claim 10 further comprising a coupling interconnecting said rotor and said input shaft.

17. A jetting apparatus comprising:

a motor section adapted for providing rotation in response to a flow of fluid therethrough, said motor section comprising a progressive cavity motor;

a speed reducer section defining a flow passage therethrough and connected to said motor section such that an output speed of said speed reducer section is less than an output speed of said motor, said speed reducer section comprising:

a body defining a geared surface therein;

a follower gear in geared engagement with said geared surface and rotatably disposed in said body, said follower gear being a wobble gear tilted with respect to a central axis of said body; and an input shaft connected to said motor, said input shaft having an eccentric portion engaging said follower gear such that, as said input shaft is rotated, said follower gear is rotated eccentrically in said geared surface; and a jetting section attached to said speed reducer section and rotated thereby at said output speed of said speed reducer section, said jetting section defining a jetting port in communication with said flow passage through which said fluid is jetted.

18. A rotating mole apparatus comprising:

a hydraulic motor comprising a rotor which is rotatable in response to a flow of fluid through said motor;

a speed reducer comprising:

a body attached to said motor;

an inner geared surface disposed in said body;

a follower gear rotatably disposed in said body and defining a bore therein; and an input shaft connected to said rotor and having an eccentric portion engaging said bore in said follower gear such that, as said input shaft is rotated, said follower gear is rotated eccentrically in said inner geared surface;

wherein, said follower gear is tilted out of a longitudinal axis of the apparatus as a result of the engagement thereof by said input shaft; and a jetting body attached to said follower gear and rotatable therewith, said jetting body defining a jetting port through which said flow of fluid is jetted.

19. A rotating mole apparatus comprising:

a hydraulic motor comprising a rotor which is rotatable in response to a flow of fluid through said motor;

a speed reducer comprising:

a body attached to said motor;

a first inner geared surface disposed in said body;

a second inner geared surface disposed in said body;

a first follower gear rotatably disposed in said body and defining a bore therein and having an eccentric portion thereon;

an input shaft connected to said rotor and having an eccentric portion engaging said bore in said first follower gear such that, as said input shaft is rotated, said first follower gear is rotated eccentrically in said first inner geared surface; and a second follower gear rotatably disposed in said body, said eccentric portion of said first follower gear engaging said second follower gear such that, as said first follower gear is rotated, said second follower gear is rotated eccentrically in said second geared surface;

wherein, said engagement of said input shaft with said first follower gear and said eccentric portion of said first follower gear with said second follower gear results in tilting of said first follower gear and said second follower gear out of a longitudinal axis of the apparatus; and a jetting body attached to said follower gear and rotatable therewith, said jetting body defining a jetting port through which said flow of fluid is jetted.

20. A rotating mole apparatus comprising:

a hydraulic motor comprising a rotor which is rotatable in response to a flow of fluid through said motor;

a speed reducer comprising:

a body attached to said motor;

an inner geared surface disposed in said body;

a follower gear rotatably disposed in said body and defining a bore therein; and an input shaft having an eccentric portion engaging said bore in said follower gear such that, as said input shaft is rotated, said follower gear is rotated eccentrically in said inner geared surface;

a coupling comprising a U-joint assembly interconnecting said rotor and said input shaft; and a jetting body attached to said follower gear and rotatable therewith, said jetting body defining a jetting port through which said flow of fluid is jetted.

* * * * *